United States Patent [19]

Ito et al.

[11] 4,308,668

[45] Jan. 5, 1982

[54] PROCESS FOR HEAT TREATMENT OF COAL

[75] Inventors: Yoshifumi Ito; Yoshihiko Nishimoto; Kiyomichi Taoda; Fumiaki Sato; Takashi Ueda, all of Hiroshima; Seibi Uehara, Tokyo, all of Japan

[73] Assignee: Mitsubishi Jukogyo Kabushiki Kaisha, Tokyo, Japan

[21] Appl. No.: 154,760

[22] Filed: May 30, 1980

[30] Foreign Application Priority Data

Jun. 4, 1979 [JP] Japan ..... 54-68865

[51] Int. Cl.[3] ..... F26B 21/10

[52] U.S. Cl. ..... 34/30; 34/48; 34/62; 201/9

[58] Field of Search ..... 201/9, 41; 202/150; 44/10 H, 10 G; 34/26, 27, 28, 29, 30, 31, 48, 62, 66

[56] References Cited

U.S. PATENT DOCUMENTS

| | | | |
|---|---|---|---|
| 2,815,316 | 12/1957 | Kruppa et al. | 201/9 |
| 3,337,417 | 8/1967 | Albright | 201/9 |
| 4,099,933 | 7/1978 | Johnson et al. | 201/9 |

*Primary Examiner*—Larry I. Schwartz
*Attorney, Agent, or Firm*—Holman & Stern

[57] ABSTRACT

In a process for heat treatment, highly hygroscopic coal, with a low carbon content and large equilibrium moisture, is rapidly heated with hot gas at a rate of temperature rise of at least 100° C./min up to a final heating temperature in the range of 300°-500° C., and is then rapidly cooled at a rate of temperature drop of at least 50° C./min to 250° C. or below. As the hot gas, an inert gas whose oxygen concentration is not higher than 4% by volume is employed. The hot gas is either caused to contain not less than 20% by volume of steam or composed solely of the steam.

5 Claims, 13 Drawing Figures

(A) (B)

(A) (B)

(A)

(B)

(C)

(D)

PARTICLE SIZE DISTRIBUTIONS OF RAW COAL AND TREATED COAL

PROCESS FOR HEAT TREATMENT OF COAL

BACKGROUND OF THE INVENTION

1. Field of the Invention

This invention relates to a process for heat treating highly hygroscopic coal having much inherent moisture with hot gas to make it less hygroscopic.

2. Description of the Prior Art

Of coals, those which have attained high degrees of coalification contain little inherent moisture and, in general, removal of surface moisture permits them to dry for use with economy. Coals with low degrees of coalification, on the other hand, have such large inherent moisture that mere removal of surface moisture is not effective enough for the drying purpose.

To achieve the end with coal of a low coalification degree, it has generally been the practice to dry the coal at elevated temperatures, high enough to drive out the inherent moisture.

Drying the less-coalified coal in this way, however, is not helpful in lowering its hygroscopicity, and the dried coal is still highly hygroscopic. During subsequent transportation and storage, the coal takes up moisture from the air, resuming the original state minus the surface moisture (the state being hereinafter called that of equilibrium moisture). This adds to the transportation and storage cost and, moreover, the commercial value of the coal is impaired by a decrease in its calorific value.

The present invention has now been perfected in view of the foregoing, and it is a primary object of the invention to provide a process for heat treating coal with a low degree of coalification to remove its moisture, convert it to less hygroscopic and more economically valuable coal with an increased calorific value per unit weight.

SUMMARY OF THE INVENTION

In accordance with the invention, the process is characterized in that highly hygroscopic coal, with a carbon content of not more than 80% on the dry ash-free (d.a.f.) basis and an equilibrium moisture of not less than 5% weight, is rapidly heated with hot gas at a rate of temperature rise of at least 100° C./min up to a final heating temperature in the range of 300°–500° C., and is then rapidly cooled at a rate of temperature drop of at least 50° C./min to 250° C. or below.

This process contemplates reduction in the hygroscopicity of coal by taking advantage of the pyrolytic action of coal in itself. Generally, coal undergoes thermal decomposition when heated to the temperature range of 300°–500° C. Tarry material contained in the coal then becomes liquid and oozes out through the pores to the surface of the coal. The liquid tarry material, out on the coal surface, changes with time into a gaseous material and flies off. According to the invention the liquid tarry material that oozes out to the coal surface during the pyrolysis is not allowed to evaporate but is solidified to clog the pores of the coal, thus decreasing the specific surface area and reducing the hygroscopicity of the coal.

DESCRIPTION OF THE PREFERRED EMBODIMENTS

To this end, the present invention chooses the final heating temperature for coal in the range of 300°–500° C. where the pyrolysis of the coal takes place and the tarry matter therein occurs in the liquid form. From practical investigations, it has been confirmed that the temperature helpful in decreasing the hygroscopicity is 350° C. or above. Experiments have also indicated that heating of coal with hot gas to over 430° C. results in cracking and dusting due to rapid evolution of volatile gas, to an economic disadvantage. For these reasons, the preferred range of temperature for final heating with the dry gas is between 350° and 430° C.

The rate of temperature increase for the heating purpose has been fixed on the basis of practical investigations to at least 100° C./min, because the heating should be within a period of time too short for the tarry material to evaporate in the gaseous form. If the rate is below this, so much volatile gas will evolve that the effect of decreasing the specific surface area and therefore reducing the hygroscopicity of the coal will be limited. The large production of volatile gas decreases the calorific value and reduces the economic value of the coal accordingly. At the same time, the volatile gas finds its way into the hot gas acting as the heating medium. This necessitates facilities for the heat treatment to purify the heating gas, with consequent increases in equipment and running cost.

If the coal, rapidly heated at the above-specified rate of temperature rise to the specified final temperature, is kept at that temperature for many hours, the tarry matter will decompose to form volatile gas, which in turn will present the afore-mentioned disadvantages. Therefore, the coal once heated to the final heating temperature must be rapidly cooled to a temperature below the thermal decomposition point of the coal. The cooling temperature, in theory, has only to be under 300° C., or in the range where the pyrolysis of coal will not be induced. However, the coal after the cooling is often exposed to the air, leading to ignition or explosion. To preclude such hazards, the coal is actually cooled down to 250° C. or below.

With the view to preventing the evolution of volatile gas, the rate of temperature drop has been fixed to at least 50° C./min on the basis of practical studies.

Another object of the invention is to avoid burning of coal when it is modified by heating with hot gas.

In the present invention, gas is used as a heating medium for coal because of the ease with which the equipment is operated and also of the good thermal efficiency. Since coal is heated above its ignition temperature, an inert gas whose oxygen concentration is not higher than 4% by volume is employed as the heating gas in order to prevent explosion as well as loss due to burning of the coal. The inert gas to be employed may be a conventional one available on the market. It will minimize the loss by burning of coal and prevent its explosion.

Still another object of the invention is to preclude the cracking of coal on heating to upward of 430° C.

In accordance with the invention, the hot gas is either caused to contain not less than 20% by volume, preferably not less than 50% by volume, of steam or composed solely of the steam so that the steam can avoid quick gasification of the volatile matter inside coal, cracking, exposure of the pores to the atmosphere, and an increase in the hygroscopicity of the coal.

The process of the invention, and the effects and advantages attained thereby will be described in more detail below in connection with the accompanying drawing illustrating examples of the invention.

EXAMPLES

Raw coal

Figure 1:
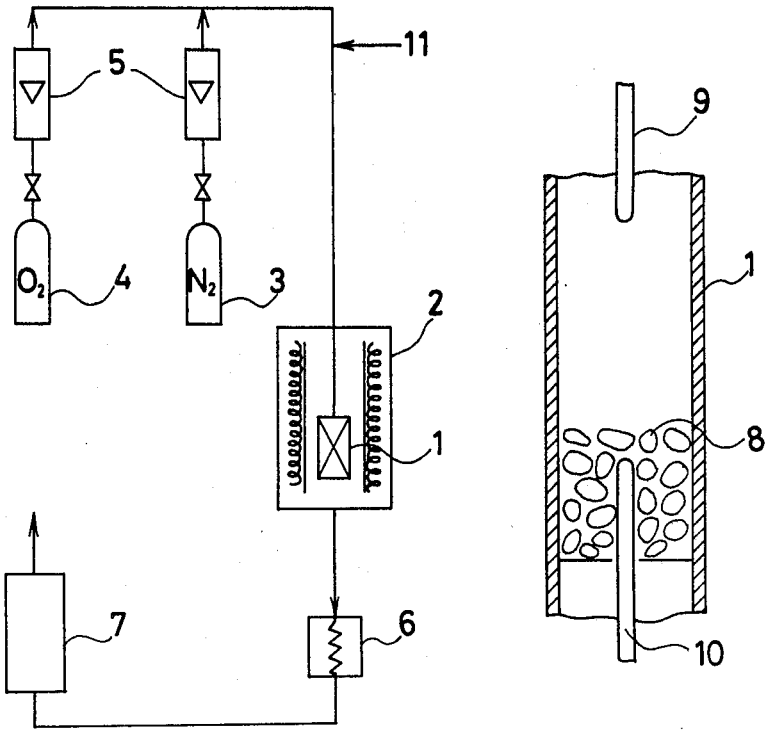
FIGS. 1(A) and (B) are schematic views of an apparatus used for examples of the invention.

Canadian coal classified as "high-volatile bituminous" in conformity with the ASTM standards. Its properties are as shown in Table 1.

TABLE 1

| | | |
|---|---|---|
| Equilibrium (inherent) moisture | : 11.0 wt % | On the non-surface moisture basis |
| Ash content | : 10.2 wt % | |
| Volatile content | : 35.7 wt % | |
| (39.8% on D.B.)* | | |
| Fixed carbon | : 40.4 wt % | |
| Calorific value | : 5700 kcal/kg | |
| C | : 71.0 wt % | On the d.a.f. basis |
| H | : 6.6 wt % | |
| N | : 1.6 wt % | |
| Total S | : 0.64 wt % | |
| O | : 19.6 wt % | |

*D.B. (Dry Base) = Based on the state freed of not only the surface moisture but the inherent moisture as well.

Apparatus employed

The apparatus used is schematically represented in FIGS. 1(A) and (B), which are a general view and an enlarged view of a heating tube 1, respectively. As shown in the both figures, a heating tube 1 having an inside diameter of 23 mm is charged with about five grams of coal 8. $N_2$ gas 3 or, when necessary, its mixture with $O_2$ gas 4 is passed through the tube at a predetermined rate of flow, with the composition under control by separate flow meters 5. During this procedure, the charge is heated at a predetermined rate of temperature rise by a heater 2. The heated gas is supplied with steam or water to form hot steam-containing gas. The gas from the heater enters a cooler 6, where it is cooled and then its hydrocarbon concentration is determined by a hydrocarbon meter 7. After the coal 8 has been heated to a predetermined temperature, the heater 2 is switched off and the coal is forcibly cooled by cold air at a predetermined rate of temperature drop. The gas temperature at the inlet of the heating tube 1 is measured by a thermocouple 9 and the temperature of the coal 8 by another thermocouple 10.

Heat-treating conditions

Figure 2:
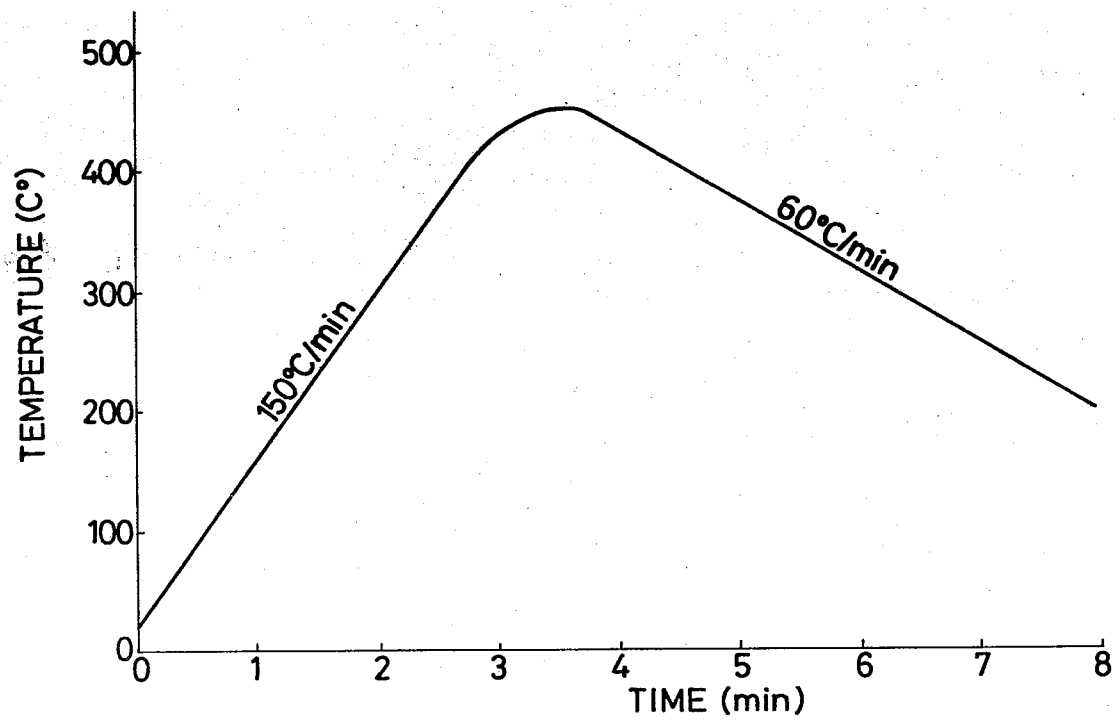
FIG. 2 is a curve representing the pattern of heat-treatment conditions in examples of the invention.

The heat treatment was carried out in the pattern represented by a curve in FIG. 2.

Analytical methods

Equilibrium moisture = The moisture of the heat-treated coal, placed in a desiccator with a saturated sodium chloride solution (75% humidity), was measured in conformity with the testing procedure of the Japanese Industrial Standards M-8812.

Volatile content = Measured also in conformity with JIS M-8812.

Specific surface area = Measured according to the BET method with $N_2$ gas.

Hydrocarbons in exhaust gas = Continuously measured in terms of methane by the FID method.

Coal surface observation = The surface conditions were observed through a scanning type electron microscope with magnifications ranging from ×100 to ×1000.

The results are graphically summarized in FIGS. 3 through 7.

Figure 3:
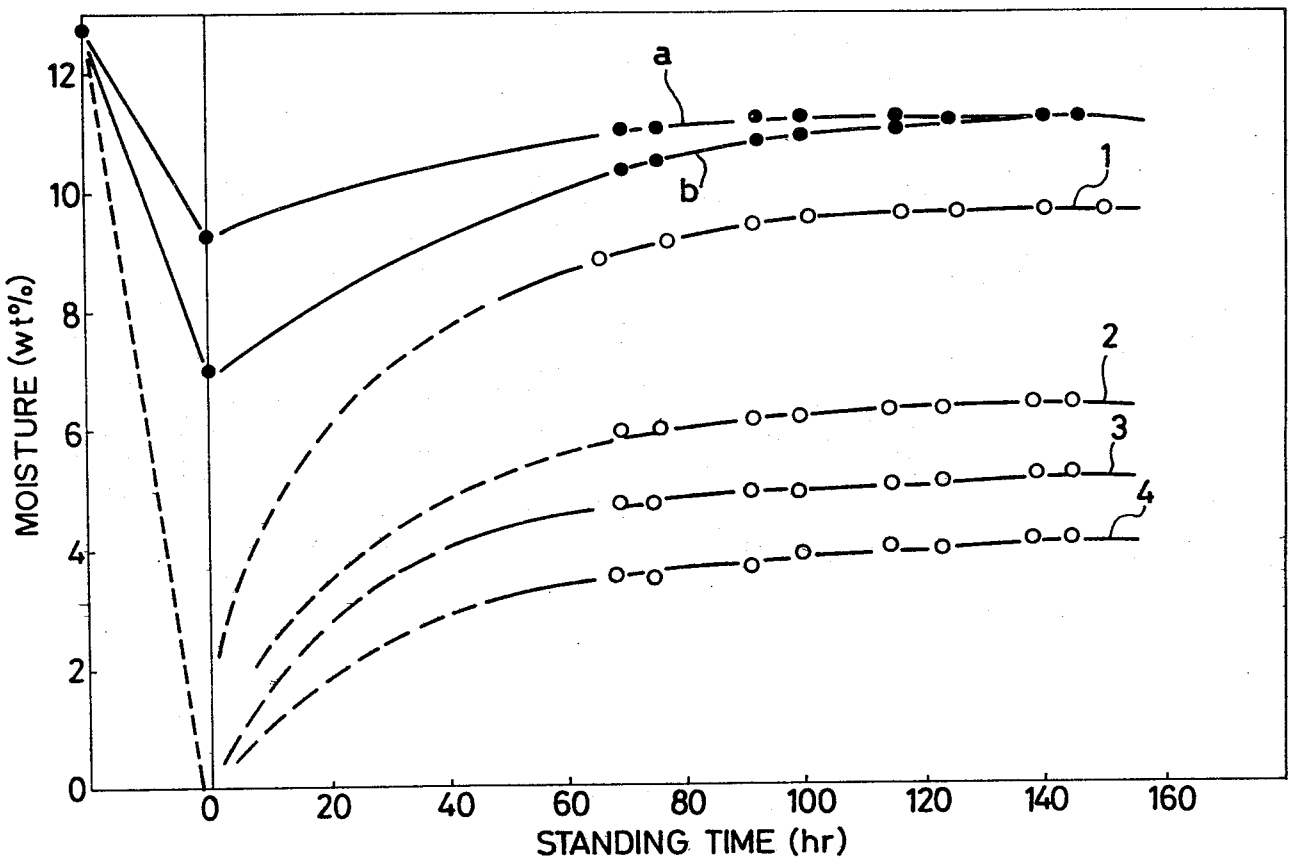
FIG. 3 is a graph showing changes in the moisture at the final heating temperature.

FIG. 3 shows changes in the moisture content of coal, originally conditioned to contain 12.6% moisture, treated under the above-mentioned heat-treating conditions with the apparatus illustrated in FIG. 1, and then allowed to stand over a period of 140 hours in a humidistat vessel kept at 75% humidity. The curve 1 represents the results with a sample treated at the final heating temperature of 300° C., the curve 2 at 350° C., the curve 3 at 400° C., and the curve 4 at 430° C. The curves a and b indicate changes in the moisture of conventionally dried coal examined in the same way, the curve a representing the results with a sample dried at 50° C. for one hour and the curve b with a sample dried at 110° C. for one hour.

As can be seen from FIG. 3, while the moisture in coal always reaches the equilibrium value in 140 hours, the coal treated in accordance with the process of the invention has much lower equilibrium moisture than that of conventionally dried coal, indicating sharp reduction of the hygroscopicity of coal made possible by the process of the invention. It can also be confirmed that the equilibrium moisture is related to the final heating temperature and, although the final heating at lower than 350° C. is not appreciably beneficial, that at 350° C. or over will reduce the equilibrium moisture to less than about half the value of the ordinarily dried coal.

Figure 4:
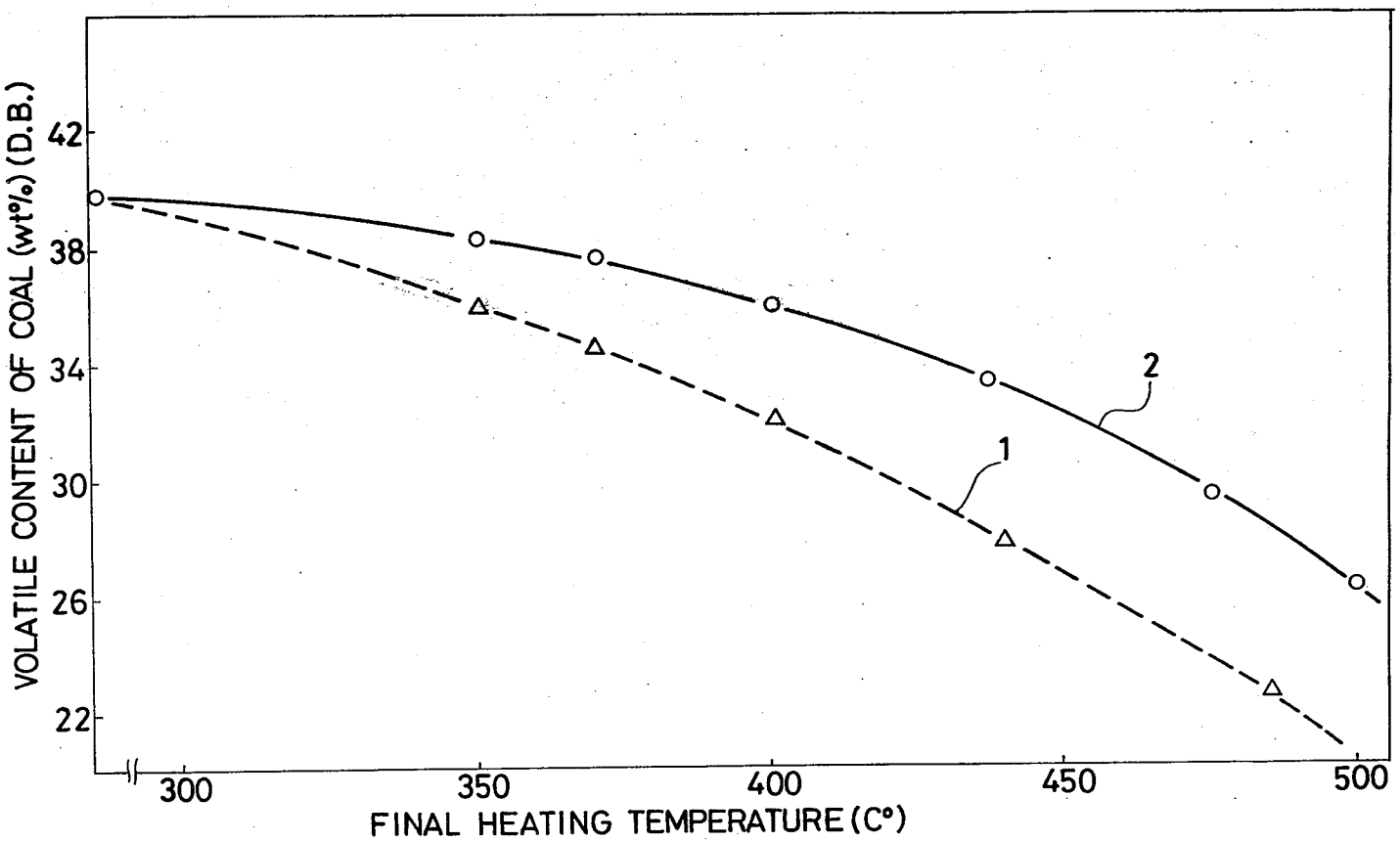
FIG. 4 is a graph showing changes in the volatile content of coal with the final heating temperature.

FIG. 4 shows the residual volatile contents (D.B.) of coals once heated up to predetermined final heating temperatures by slow heating at a rate of temperature rise of 10° C./min (curve 1) or by rapid heating at a rate of 150° C./min (curve 2) (in both cases followed by cooling under the above-mentioned conditions at the rate of 60° C./min).

It will be appreciated from FIG. 4 that the residual volatile contents of coals, subjected to final heating to the range of 350°–430° C. by slow heating (curve 1), are low in the range of 36–29% (D.B.), but the values of coals heated rapidly (curve 2) are nearly unchanged in the range of 38–34% (D.B.). This means that the gas can be easily scrubbed as the heating medium and also that the decrease in the calorific value of coal due to the evolution of volatile matter is very low according to the invention, thus offering no factor that will depreciate the economic value of the heat-treated coal.

Figure 5:
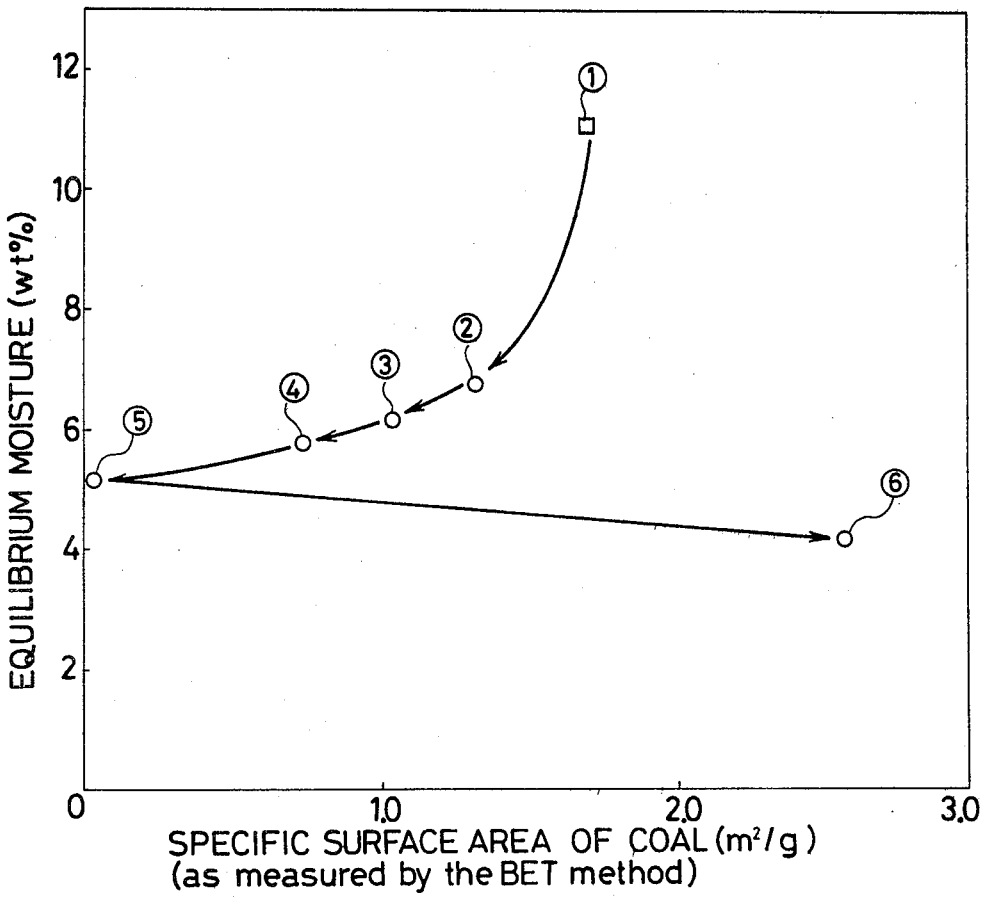
FIG. 5 is a graph showing changes in the specific surface area and equilibrium moisture with the final heating temperature.
Figure 6:
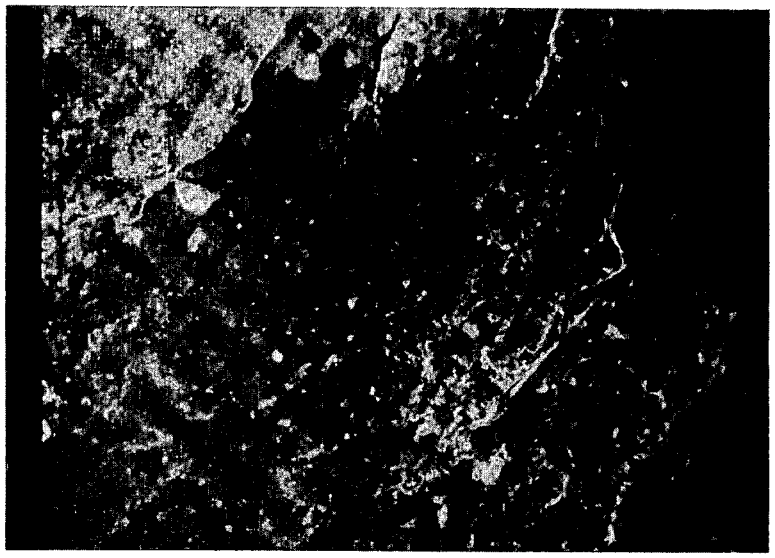
FIGS. 6(A) through (D) are micrographs taken through a scanning type electron microscope, magnification ×100, of coal surfaces at different final heating temperatures.
Figure 6:
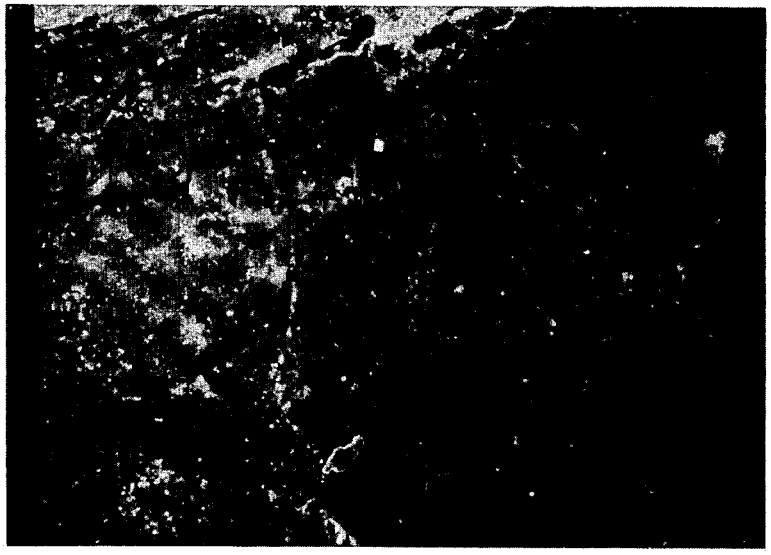
Figure 6:
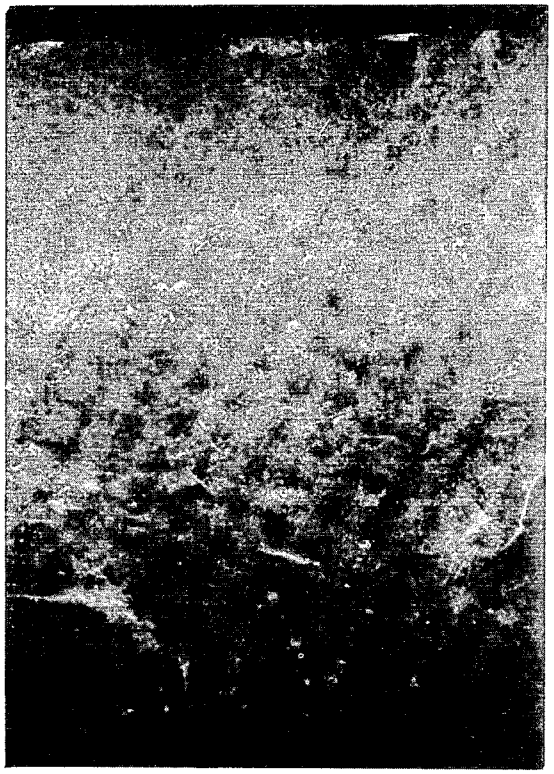
Figure 6:
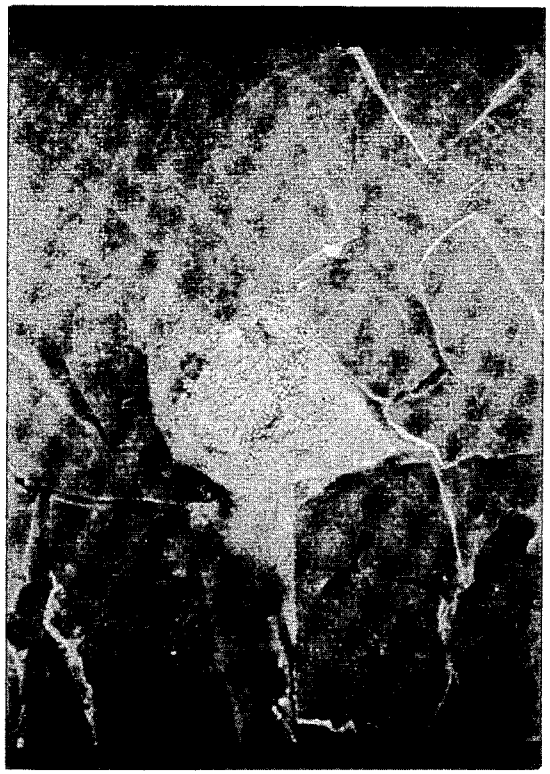

FIG. 5 depicts how the specific surface area of coal is reduced by the process of the invention and also its relation with the equilibrium moisture of coal. The raw coal (1) indicates a specific surface area of about 1.7

$m^2/g$, but, after the treatment at a final heating temperature above 350° C. (2) [e.g., at 370° C. (3), 400° C. (4), or 430° C. (5)], the specific surface area will be sharply decreased, down to about 0 $m^2/g$ after the treatment at 430° C. (5). Beyond this level, however, the area begins to increase, amounting to 2.6 $m^2/g$ when treated at 475° C. (6).

The last-mentioned phenomenon is explained by the fact that, because of the employment of dry gas free from steam as the heating gas, the treatment at the final heating temperature of over 430° C. (5) causes rapid evolution of volatile gas which, in turn, induces cracking inside the coal.

In order to clarify this, microphotographs taken with a scanning electron microscope, all at a magnification of ×100, are shown in FIGS. 6(A) through (D). FIG. 6(A) is a micrograph of raw coal [(1) in FIG. 5], and (B) to (D) are micrographs of coal treated, respectively, at the final heating temperatures of 370° C., 400° C., and 475° C. [(3), (4), and (6) in FIG. 5]. FIGS. 6(A), (B), and (C) show coal surfaces almost unchanged, whereas FIG. 6(D) reveals numerous cracks tending to reduce the coal to fine particles.

Figure 7:
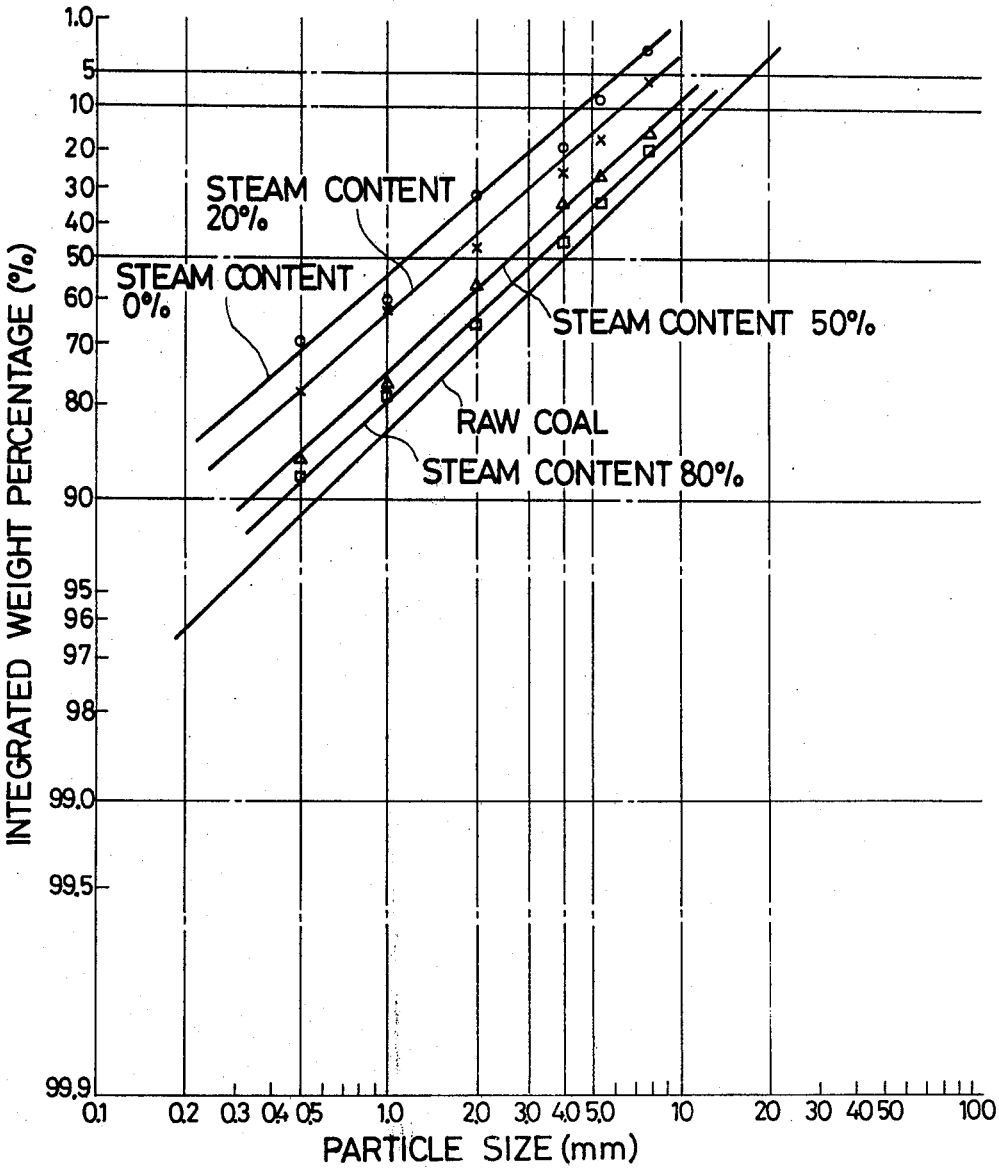
FIG. 7 is a graph showing the particle size distributions of raw coal and coal treated at the final heating temperature of 450° C. with hot gas containing varied proportions of steam.

FIG. 7 shows the results of experiments with hot gas containing varied proportions of steam and used to treat coal so as to attain the final heating temperature of 450° C. The particle size of the coal before the heat treatment was such that particles one millimeter or larger in diameter accounted for 84% of the total weight and particles 8 mm or larger accounted for 26%. With the coal treated with hot inert gas free from steam, the percentages were, respectively, 55% and only 1%, indicating serious cracking and reduction in size of the coal. In contrast with them, the coal treated with hot gas containing 50% by volume of steam showed much higher values of 75% and 19%, respectively, that is, no marked differences from the particle size distribution before the treatment, with a less tendency toward reduction in particle size than that of the coal treated with the steam-free gas. It is attributed to less cracking of coal than with the latter. The less the cracking, the smaller the specific surface area and hence the lower the hygroscopicity of the coal will be.

Figure 8:
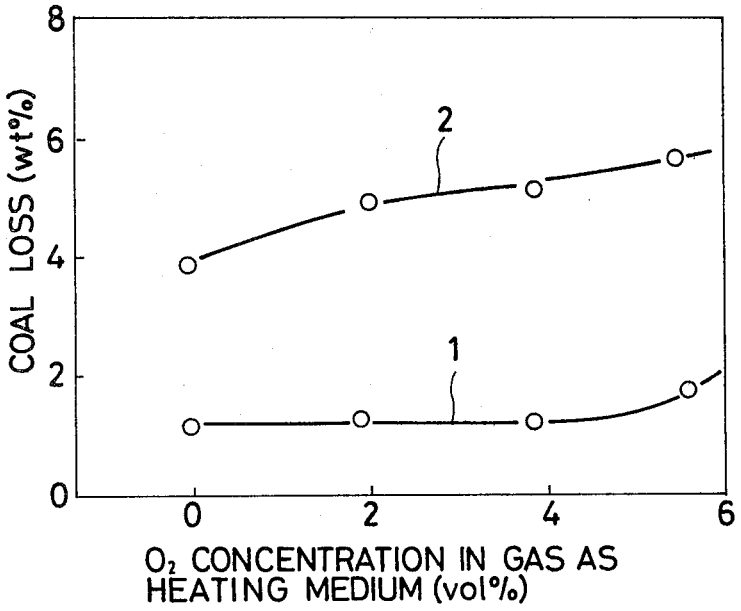
FIG. 8 is a graph showing the loss in weight of coal with the concentration of $O_2$ in the gas as the heating medium.

FIG. 8 illustrates the loss in weight of coal upon the heat treatment with $O_2$-containing hot gas as the heating medium. The curve 1 represents the results of a treatment using a final heating temperature of 400° C. and the curve 2, those using a final temperature of 500° C.

Referring to FIG. 8, the loss of coal by the treatment at the final heating temperature 400° C. with hot gas containing up to 4 vol% $O_2$ is constant regardless of the $O_2$ concentration. It indicates the loss of the volatile-matter content alone. With an $O_2$ concentration of 6 vol%, by contrast, the rate of coal loss increases slightly, suggesting that burning with $O_2$ took place. From these it is clear that practically no reaction occurs between coal and the gas as the heating medium provided the $O_2$ concentration in the gas is not greater than 4 vol%.

In view of the test results given above, the effects achieved by the process of the invention are summarized in Table 2.

TABLE 2

| | Raw Coal | Heat-treated coal Final heating temperature 350° C. | 400° C. | 430° C. |
|---|---|---|---|---|
| Equilibrium (inherent) moisture (wt %) | 11.0 | 6.8 | 5.2 | 5.0 |
| Volatile content (wt %) | 39.8 | 38.3 | 35.8 | 33.8 |
| Calorific value (kcal/kg) | 5,700 | 5,970 | 6,080 | 5,980 |

From the viewpoint of calorific value, the optimum final heating temperature is in the vicinity of 400° C. The coal treated at that temperature has a very great economic value because its calorific value is 6,080 kcal/kg, or about 400 kcal/kg more than the 5,700 kcal/kg of the raw coal.

If the final heating temperature used in heating with dry gas is lower than 350° C., the coal will have a high equilibrium (inherent) moisture and therefore a low calorific value. Conversely if the final heating temperature exceeds 430° C., much volatile matter will evolve as a result of thermal decomposition, reducing the calorific value of the coal accordingly.

When the heating is accomplished with steam-containing hot gas, the usual cracking of coal due to a heat treatment is minimized, and there will be no dusting of coal during the process of heat treatment and also in the subsequent stages of transportation and storage. The economic value of the heat-treated coal will thus be kept unimpaired.

What is claimed is:

1. A process for the heat treatment of highly hygroscopic coal having a low carbon content and high equilibrium moisture to produce a less hygroscopic coal which comprises rapidly heating the coal with hot gas at a rate of temperature rise of at least 100° C./min up to a final heating temperature in the range of 300°–500° C., and then rapidly cooling the same at a rate of temperature drop of at least 50° /min to not higher than 250° C., said hot gas comprising an inert gas with an oxygen concentration of not more than 4% by volume.

2. A process according to claim 1, wherein said hot gas contains not less than 20% by volume of steam.

3. A process according to claim 1, wherein said hot gas consists solely of steam.

4. A process according to claim 1, wherein said final heating temperature is in the range of 350°–430° C.

5. A process according to claim 1, wherein said inert gas comprises nitrogen.

* * * * *

UNITED STATES PATENT AND TRADEMARK OFFICE

CERTIFICATE OF CORRECTION

PATENT NO. : 4,308,668

DATED : January 5, 1982

INVENTOR(S) : YOSHIFUMI ITO, et al.

It is certified that error appears in the above-identified patent and that said Letters Patent are hereby corrected as shown below:

On the title page Item /30/:

-- [30] Foreign Application Priority Data

"Jun. 4, 1979 [JP] Japan.....54-68865"

SHOULD BE:

--Jun. 4, 1979 [JP] Japan.....54-68865

May 6, 1980 [JP] Japan.....55-59635--.

Signed and Sealed this

Twentieth Day of April 1982

|SEAL|

Attest:

GERALD J. MOSSINGHOFF

Attesting Officer

Commissioner of Patents and Trademarks